US006217824B1

(12) United States Patent
Leczo et al.

(10) Patent No.: US 6,217,824 B1
(45) Date of Patent: Apr. 17, 2001

(54) COMBINED FORGED AND CAST LANCE TIP ASSEMBLY

(75) Inventors: Theodore J. Leczo, Pittsburgh; Nicholas M. Rymarchyk, Jr., Baden; Stephen A. Manley, Butler; Peter J. Danek, Zelienople, all of PA (US)

(73) Assignee: Berry Metal Company, Harmony, PA (US)

( * ) Notice: Subject to any disclaimer, the term of this patent is extended or adjusted under 35 U.S.C. 154(b) by 0 days.

(21) Appl. No.: 09/315,302

(22) Filed: May 20, 1999

(51) Int. Cl.[7] ..... C21C 5/32
(52) U.S. Cl. ..... 266/225; 266/270
(58) Field of Search ..... 266/225, 217, 266/46, 270

(56) References Cited

U.S. PATENT DOCUMENTS

| | | | |
|---|---|---|---|
| Re. 28,769 | | 4/1976 | Rymarchyk et al. . |
| 3,224,749 | | 12/1965 | Bery . |
| 3,525,508 | | 8/1970 | Berry et al. . |
| 3,525,509 | | 8/1970 | Berry . |
| 3,559,974 | | 2/1971 | Berry . |
| 3,662,447 | | 5/1972 | Schweng et al. . |
| 3,750,952 | * | 8/1973 | Schwneg et al. ..... 266/225 |
| 3,823,929 | | 7/1974 | Rymarchyk et al. . |
| 3,827,632 | | 8/1974 | Rymarchyk et al. . |
| 4,052,005 | | 10/1977 | Rymarchyk . |
| 4,083,539 | | 4/1978 | Berry et al. . |
| 4,083,541 | | 4/1978 | Berry et al. . |
| 4,083,542 | | 4/1978 | Berry et al. . |
| 4,083,543 | | 4/1978 | Berry et al. . |
| 4,083,544 | | 4/1978 | Berry et al. . |
| 4,106,756 | | 8/1978 | Rymarchyk et al. . |
| 4,301,969 | | 11/1981 | Sharp . |
| 4,322,033 | | 3/1982 | Rymarchyk et al. . |
| 4,396,182 | | 8/1983 | Schaffar et al. . |
| 4,432,534 | | 2/1984 | Zanetta et al. . |
| 4,533,124 | | 8/1985 | Mercatoris . |
| 4,702,462 | | 10/1987 | Fritz . |
| 4,951,928 | | 8/1990 | Eysn et al. . |

* cited by examiner

*Primary Examiner*—Scott Kastler
(74) *Attorney, Agent, or Firm*—Klehr, Harrison; John F. Letchford

(57) ABSTRACT

A lance tip assembly for a water-cooled lance as well as a method for constructing same. The lance tip assembly includes a first component of solid cast metal which is secured to a second or lower component of forged metal. Each active material discharge nozzle of the combined forged and cast lance tip assembly is constructed in part of the first cast component and in part of the second forged component. Only a single bond is required to join the first and second component at each nozzle site. The first and second components are fabricated to include structural features which individually and collectively promote high coolant water flow velocity through the lance tip and substantially uniform cooling of face of the lance tip.

10 Claims, 2 Drawing Sheets

COMBINED FORGED AND CAST LANCE TIP ASSEMBLY

FIELD OF THE INVENTION

The present invention relates in general to steelmaking equipment and in particular to steelmaking lances.

BACKGROUND OF THE INVENTION

In many steelmaking processes, water-cooled steelmaking lances are inserted into a steelmaking furnace vessel (e.g., a basic oxygen furnace (BOF), electric arc furnace (EAF), etc.), to promote melting, decarburization, refining and other processes useful in converting iron-containing scrap material within the vessel into steel. A typical lance may inject gaseous materials such as oxygen, hydrocarbon gas and/or inert gas at high velocity at various times to achieve desired treatment of the scrap metal and/or maintenance of the interior of the vessel. Some lances may also inject particulate carbon and/or lime (or similar substances) to achieve desired properties in the steel ultimately produced.

Water-cooled lances generally comprise an adapter portion, an elongated barrel portion connected at a first end thereof to the adapter portion and lance tip portion connected to a second end of the barrel portion.

The adapter portion comprises at least one inlet for receiving the gaseous and/or particulate matter to be injected into the furnace vessel, which matter will hereinafter be generally referred to as "active material." The adapter portion also includes a water outlet and a water inlet for circulating pressurized cooling water throughout the lance.

The barrel portion comprises at least three substantially concentrically arranged metal, typically steel, pipes for communicating the cooling water and/or active material(s) between the adapter portion and the lance tip portion. The outermost and first innermost pipes normally define an annular water return passageway for conveying coolant water from the lance tip portion to the adapter portion. The first and second innermost pipes normally define an annular water delivery passageway for conveying coolant water to the lance tip portion from the adapter portion. And, the interior of the second innermost pipe (and any additional pipes arranged concentrically interiorly thereof) defines at least one passageway for conveying active material from the adapter portion to the lance tip for injection into the furnace vessel.

The lance tip portion usually comprises an assembly having comprising one or more parts which may be secured by welding, soldering or the like to the concentric pipes of the barrel portion. The lance tip assembly comprises at least one nozzle in communication with the at least one active material passageway of the barrel portion for injecting or discharging the active material into the furnace vessel. The tip assembly further comprises passage means for connecting the water delivery and return passageways of the barrel portion to one another. So constructed, water or other coolant fluid may be continuously circulated through the lance to cool the lance, especially the lance tip assembly which is exposed to the greatest temperatures during lance operation. Indeed, if coolant water is not effectively conveyed through the lance tip portion then the assembly may become non-uniformly heated. This, in turn, may lead to so-called "hot-spots" or "burn-through" sites which often result in premature failure of the lance tip.

A common practice means by which the steelmaking lance manufacturing industry has sought to impart cooling to the lance tip assembly is to provide a generally centrally disposed protrusion or dimple at the inside face of the tip assembly. The object of such protrusion is to direct coolant water radially outwardly through the interior space of the lance tip to cool all areas of the working face of the lance tip. The water-diverting protrusions have assumed an assortment of sizes and shapes and have met with varying degrees of success for their intended purposes. Examples of such protrusions may be found in U.S. Pat. Nos. 3,224,749; 3,525,508; 3,525,509; 3,823,929; 3,827,632; 4,083,539; 4,083,541; 4,083,542; 4,083,543; 4,083,544; 4,106,756; 4,230,033; 4,322,033; 4,432,534; 4,702,462; 4,951,978 and Reissue Pat. No. 28,769. None of these patents appear to suggest any cooling advantages arising from engineering the interior space of the lance tip assembly, including or separate from the aforesaid protrusion, to achieve a substantially uniform cooling of the working face of the lance tip. Moreover, these patents acknowledge cooling benefits that might arise by minimizing the distance between the coolant water as it is circulated across the inside face of the tip assembly and the critical nozzle exit. The phrase "critical nozzle exit", as used herein, shall be construed to mean the radially innermost point of the discharge opening of each nozzle in the lance tip in relation to the geometric center of the lance tip. In contrast, the present inventors have discovered that by minimizing the distance between the coolant water and the critical nozzle exit, relative cold and hot spots are reduced at the working face of the tip, thereby reducing nozzle erosion and burn-through at the outside surface of the tip face.

U.S. Pat. Nos. 4,052,005 and 4,951,928 have acknowledged the desirability of providing elevated coolant water flow velocity at the inside face of the lance. However, the elaborate lance tip constructions disclosed therein are costly and difficult to manufacture and do not assure that optimum water flow velocity and attendant uniform tip cooling can be reliably achieved in lances of varying size. U.S. Pat. No. 4,951,928, for example, provides for radially asymmetrically arranged secondary channels or pipes which are disposed within the coolant water delivery passageway to create a radially asymmetric flow at the center or protrusion region of the lance tip. However, no reference is made to any optimum water flow velocity at the protrusion or any other region of the interior face of the tip or that the secondary channels can achieve uniform velocities and/or cooling capabilities in areas of the working face other than the protrusion.

The prior art also includes lance tip assemblies made from one or more pieces of forged or cast copper. For example, U.S. Pat. No. 4,396,182 discloses a single piece copper casting; U.S. Pat. No. 4,533,124 teaches a one or two piece copper casting; U.S. Pat. No. 4,301,969 provides a one piece forged copper member; U.S. Pat. Nos. 3,662,447 and 4,702,462 describe multipiece forged copper constructions; and U.S. Pat. No. 3,559,974 discloses a multipiece assembly comprising a worked, e.g., forged, copper base portion welded to a cast copper body portion. Of these, U.S. Pat. No. 3,559,974 couples the deterioration resistance afforded by the dense, fine-grained structure of a copper forging at the exposed working face lance tip with the economy of a copper casting at the interior of the lance which is subject to far less heat and caustic conditions than the working face.

The lance tip assembly disclosed in U.S. Pat. No. 3,559,974 also includes worked, e.g., forged, copper exit conduits and nozzles for discharging oxygen into the furnace vessel. The worked discharge nozzles are structural elements distinct from both the cast copper body portion and the worked base portion and require three separate welds per nozzle to secure the nozzle to the body and base portions. The very number of nozzle welds required to join the body and base portions considerably complicates assembly of the lance tip structure and increases the likelihood of weld failure during lance operation.

An advantage exists, therefore, for a combined forged and cast lance tip assembly which is comparatively easy to assemble and durable in operation which further provides substantially uniform cooling of the working face of the lance tip by providing high coolant water flow velocity throughout the tip and optimizing the shape characteristics of the interior space of the tip.

SUMMARY OF THE INVENTION

The present invention provides a lance tip assembly for a water-cooled lance as well as a method for constructing same. The lance tip assembly comprises a first or upper component of solid cast copper or brass which is secured, preferably by brazing, to a second or lower component of solid forged copper. Each active material discharge nozzle of the combined forged and cast lance tip assembly is comprised in part of the first cast component and in part of the second forged component. Only a single braze is required to join the first and second component at each nozzle site. The first and second components are fabricated to include structural features which individually and collectively promote high coolant water flow velocity through the lance tip and substantially uniform cooling of face of the lance tip.

Other details, objects and advantages of the present invention will become apparent as the following description of the presently preferred embodiments and presently preferred methods of practicing the invention proceeds.

BRIEF DESCRIPTION OF THE DRAWINGS

The invention will become more readily apparent from the following description of preferred embodiments thereof shown, by way of example only, in the accompanying drawings wherein.

DETAILED DESCRIPTION OF THE INVENTION

Figure 1:
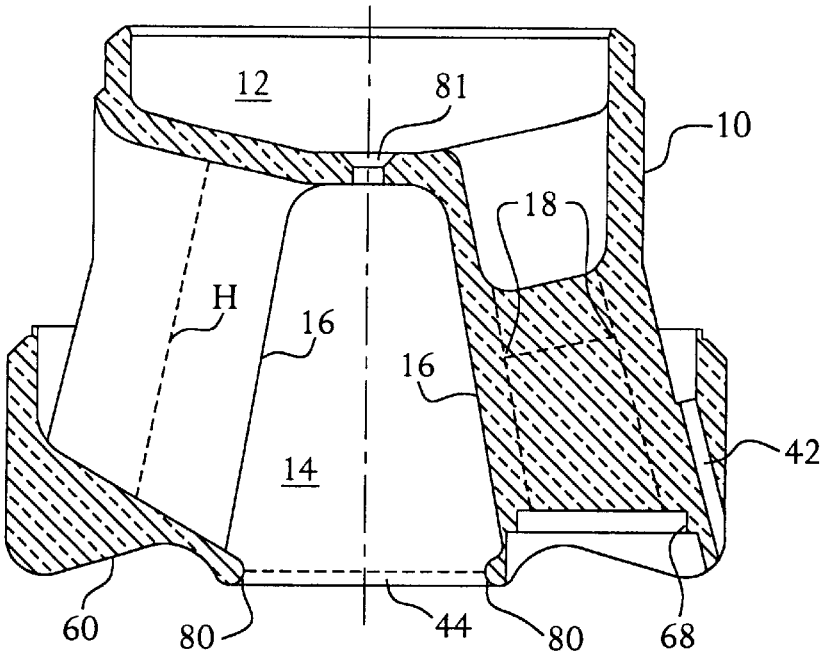
FIG. 1 is a elevational cross-section through a first cast metal component of the lance tip assembly according to the present invention.
Figure 2:
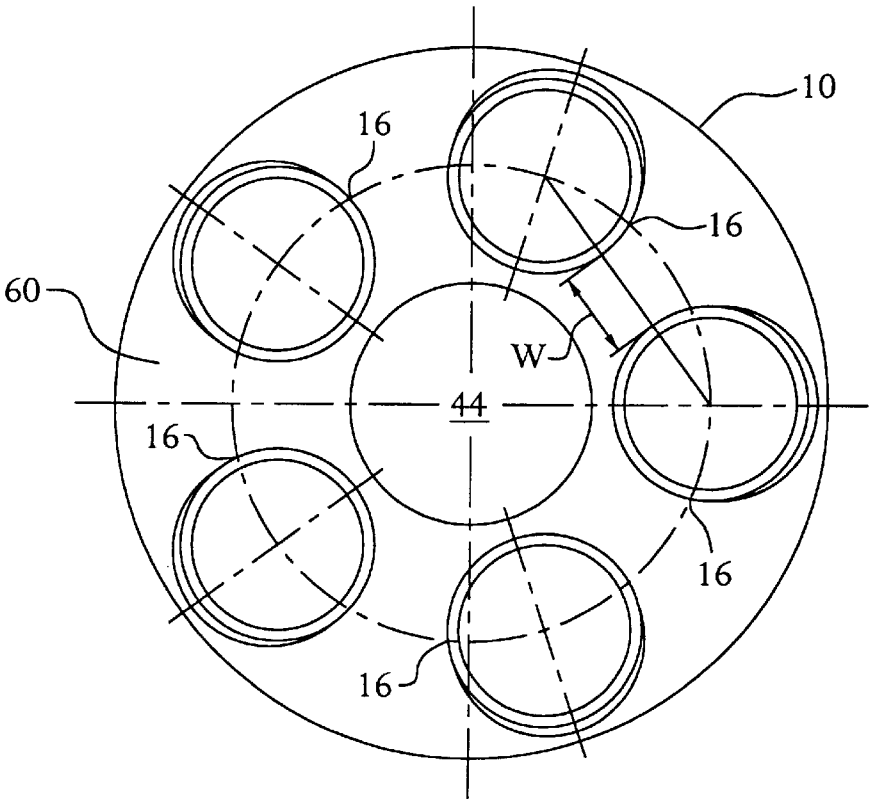
FIG. 2 is a bottom view of the first component shown in FIG. 1.

Referring initially to FIG. 1, the first or upper component of the lance tip assembly is identified by reference numeral 10. First component 10 is a solid cast metal member, preferably copper or brass, including an active material flow space 12 and a first coolant fluid flow space 14. At least one nozzle blank 16 is formed during casting of first component 10. The base of the active material flow space 12 is desirably provided with a hole 81 into which a post 82 (FIG. 4) is inserted and sealed to provide support for the center of a second lance tip component 26, described below. The illustrated example in FIG. 2 depicts five outwardly divergent nozzle blanks 16 equiangularly disposed about the first component 10. However, any desired number of nozzle blanks 16 in any desired orientation may be provided in the first component. Nozzle blanks 16 are thereafter bored, as indicated by dashed lines 18, to form nozzles 20 having nozzle passageways 22 shown in the final assembly illustrated in FIG. 4. Nozzle passageways 22 permit gaseous and/or particulate active material to pass from the active material flow space 12 through corresponding discharge openings 24 formed in the working face 25 of the second lance tip component 26 (FIG. 3, discussed below) to be discharged from the lance tip assembly and into a unillustrated steelmaking vessel. Before or after formation of nozzles 20, the nozzle blanks 16 are machined to form sockets 68 adapted to accommodate correspondingly machined parts of the second component 26 as described below.

Figure 3:
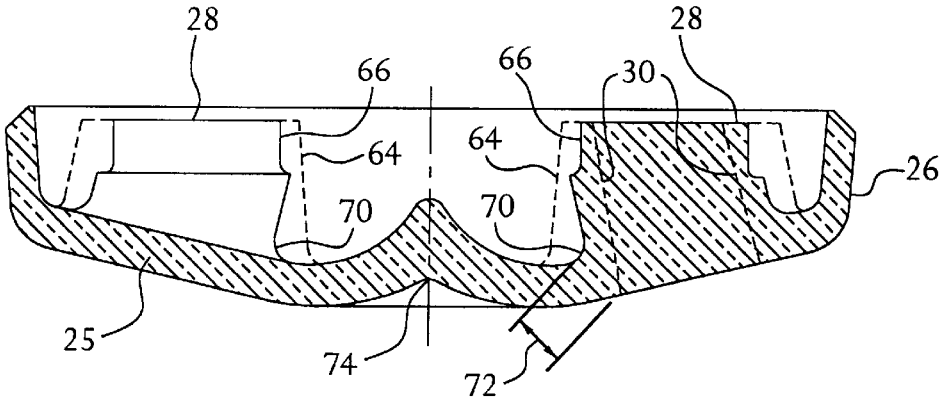
FIG. 3 is an elevational cross-section view of a second forged metal component of the lance tip assembly according to the present invention.

Turning to FIG. 3, the second or lower component 26 of the lance tip assembly of the present invention is a solid forged metal preferably, although not necessarily, fabricated from copper or brass. Second component 26 includes at least one forging leg 28 formed during forging which correspond in number and disposition to the lower ends of the nozzle blanks 16 (FIG. 1). Forging legs 28 are thereafter bored, as indicated by dashed line 30, to form extensions of nozzles 20 and nozzle passageways 22 as well as discharge openings 24 in working face 25 (FIG. 4) to permit flow of active material through the lance tip assembly and into the furnace vessel. Once assembled to one another, as will be described below, the upper ends of the concentric walls of components 10 and 26 are fixedly attached using suitable bonding material by welding, soldering, brazing, adhesion, or the like, as indicated by 32*a*, 34*a* and 36*a*, respectively, to the lower ends of concentric steel pipes 32, 34 and 36 of the barrel portion of an elongated lance as shown in FIG. 4.

Figure 4:
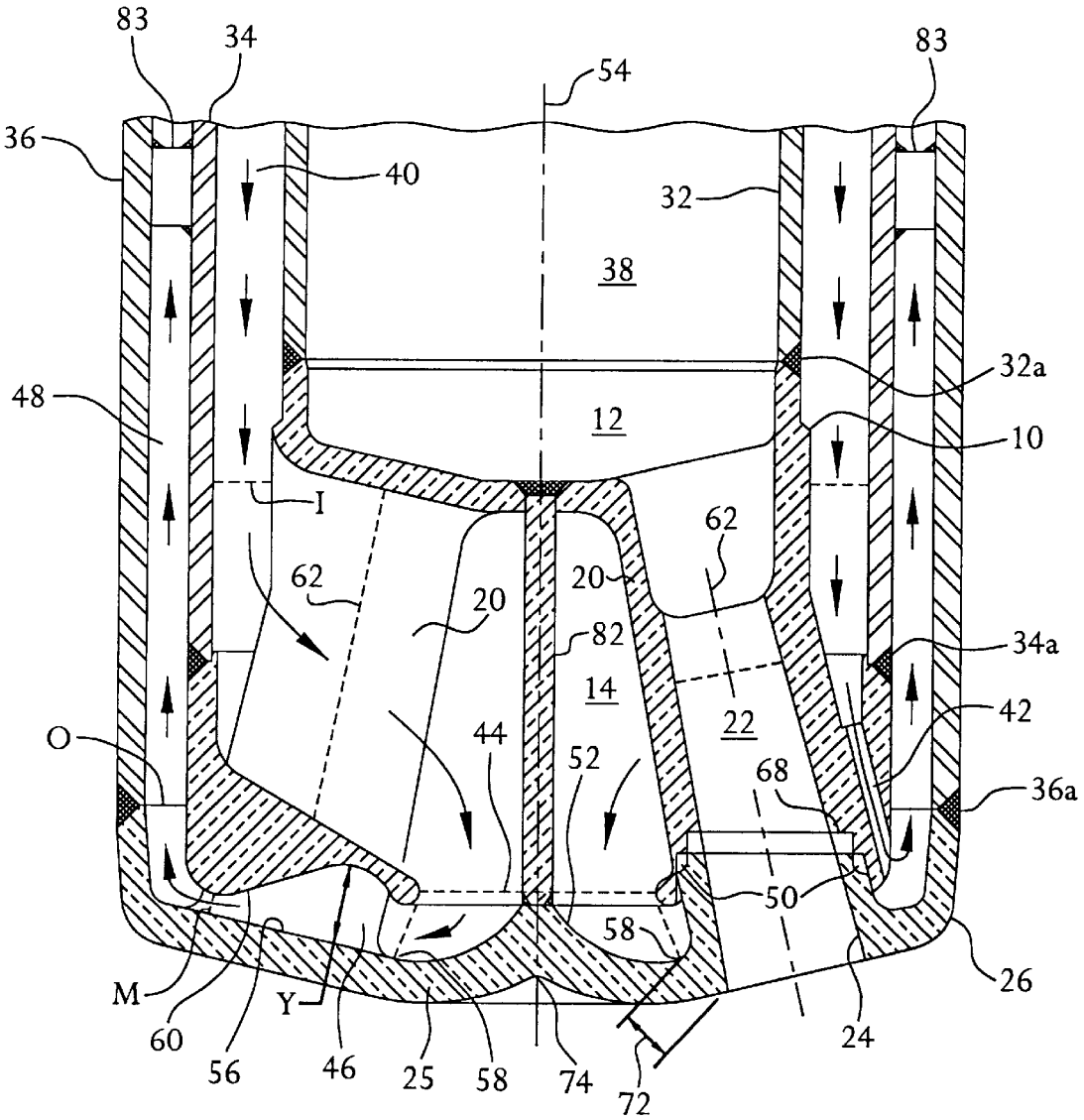
FIG. 4 is an elevational cross-section view of the lance tip assembly of the present invention in assembled condition.

As seen in FIG. 4, central pipe 32 defines a central passageway 38 for delivering pressurized active material to the active material flow space 12 of the first component 10. From space 12 the active material passes through nozzle passageways 22 and discharge openings 24 into the steelmaking vessel. An annular space formed by pipe 32 and pipe 34 defines a coolant fluid inlet passageway 40 which is connected to an unillustrated supply of cooling water and delivers water to the lance tip assembly. The support post 82 is preferably fabricated from copper or steel and is affixed by welding or the like to protrusion 52, described below, and the base of the active material flow space 12 along a central longitudinal axis 54 of the tip assembly. The support post 82 is shown to add support to the center of the second component 26 during operation. A plurality of spacers 83 are preferably welded firmly to the inner sleeve 34 and outer sleeve 36 to prevent relative motion of the first component 10 and the second component 26 during operation. FIGS. 1 and 4 reveal that the first cast component 10 further preferably, although not necessarily, includes at least one internally formed bypass passageway 42 desirably corresponding in number and disposition to nozzles 20 to enable cooling of the radially outermost areas thereof. During lance operation, coolant water continuously flows through coolant fluid delivery passageway 40 into passage means provided in the lance tip assembly and then into a coolant fluid return passageway 48. More particularly, coolant water flows downwardly through passageway 40 and bypass passageway(s) 42 (if present), around the exterior surfaces of nozzles 20, into the first coolant fluid flow space 14, through a discharge opening 44 thereof (FIGS. 1, 2 and 4) and then into a second coolant fluid flow space 46 established between the first and second components 10, 26 of the lance tip assembly. While in space 46, the coolant water flows around the exterior surfaces of the bored forging legs 28 (which form the lower portions of the nozzles 20 when the first and second components are joined to one another) in a manner generally indicated by the water flow arrows shown in FIG. 4. Upon exiting space 46, the coolant water combines with the coolant water exiting bypass passageway (s) 42, if present, and enters a coolant fluid return passageway 48 formed between pipes 34 and 36 whereupon the water is returned from the lance tip to the coolant water supply and is again recirculated through the lance.

Joining disparate materials such as metal castings and metal forgings to achieve the tensile strength required for maintaining the integrity of a multi-part lance tip assembly is problematic. To illustrate, U.S. Pat. No. 3,559,974 discloses an assembly wherein three welds are required to secure each supplemental worked or forged nozzle to the cast body and forged base members of the assembly. The present invention provides, among other things, a process by which the first cast component 10 and second forged component 26 may be joined to one another via a single juncture site 50 per nozzle 20.

According to a presently preferred embodiment, the first component 10 is inverted and mounted in the braze fixture. The joint surfaces in the cast and forged components are cleaned and a brazing flux applied. A suitable amount of brazing material is inserted into first component 10 at each junction site 50 (FIG. 4). The second component 26 is inverted and assembled with the first component 10. Each joint is heated from within the nozzle bore passageway 22 until the brazing material flows from the junction site 50 into the nozzle passageway 22. The procedure is performed on each nozzle until the assembly is complete.

The resultant joint at each nozzle 20 between the first and second components 10 and 26 is a high strength, high temperature joint which is resistant to water leaks and related failures that might otherwise occur at the elevated temperatures normally encountered in a steelmaking vessel.

The present inventors have also discovered that cooling of the second forged component 26 may be more uniformly achieved, inter alia, by controlling the relative sizes of the water inlet and outlet areas of the lance tip. The water inlet area of the lance tip assembly may be defined as the annular area (represented by dashed line "I" in FIG. 4) between the lance tip assembly and pipe 34 at or, as illustrated, generally near the juncture site 32*a* of first component 10 and pipe 32. Similarly, the water outlet area "O" of the lance tip assembly may be defined as the annular area between the lance tip assembly and pipe 36 at or generally near the juncture site 36*a*. In particular, improved cooling of the working face 25 of the second forged component 26 occurs when the combined between-nozzle water inlet area N and the bypasses 42 is greater than the water outlet area O. More specifically, N is the sum of the substantially triangular areas between each of nozzles 20 as defined by height "H" (FIG. 1) and base width "W" (FIG. 2). Thus, for a constant mass flow of coolant water through the lance tip assembly, the velocity of the water exiting the assembly will be greater than the velocity of the water entering the assembly. In research and development culminating in the present invention, the present inventors have observed that an accelerating water velocity through the lance tip assembly, and especially across the inside surface of the working face 25 of the second component 26, produces improved, more uniform cooling at the second component which reduces hot spots, burn-throughs and other temperature-related failures of the lance tip.

As an extension of the notion of improving cooling of a lance tip assembly by accelerating the speed of water flow through the assembly, the present inventors have also discovered that by precisely designing the available area for water flow between the nozzles 20 for coolant water traversing the inside surface of the working face 25, i.e., generally the area defining space 46 between the bored forging legs 28, substantially optimal water flow velocity may be achieved through space 46.

Advantages arising from optimizing water flow velocity adjacent the lower portions of the nozzles and the working face 25 include more even cooling of the nozzles and working face, more uniform heat transfer within the tip assembly, and reduction of hot-spot and similar burn-through failures.

Optimum water flow through the first component 10 is achieved by determining the maximum cooling water flow rate for the particular configuration of first component 10 and making the total between-nozzle water inlet area N plus the total bypass areas 42 approximately equal to the inlet water area I. The areas N and 42 are then adjusted until the cooling water velocity through area N is less than a preset value (always less than or equal to the cooling water velocity through the first coolant flow space discharge opening 44). The areas N and 42 are then fixed for every casting manufactured using these specific patterns.

As coolant water passes through opening 44, its direction of travel is changed, in part due to a protrusion or dimple 52 (described hereinafter) provided on the inside surface of working face 25, from substantially parallel to substantially perpendicular to the longitudinal axis 54 of the lance (FIG. 4). According to the present invention, when traversing space 46, coolant water traveling radially outwardly through the lance tip assembly experiences a substantially continuously changing flow area profile. This profile is dictated primarily by the number of nozzles 20 required to deliver the desired flow of active material into the furnace vessel and the target coolant water volume expected to be conveyed by the lance. Coolant water flow volumes may be expected to range from about 100 to about 2000 gallons per minute (gpm) through a typical water cooled lance, although greater and lesser flows may be accommodated by the present invention.

The coolant water which passes through space 46 must first pass through opening 44. The area of opening 44 is determined using formula 1:

$$A_{44} = \frac{\text{application specific coolant water mass flow rate}}{\text{design water velocity through opening 44}} \quad (1)$$

An additional means for controlling coolant fluid flow through the lance tip assembly is protrusion or dimple 52 which is preferably located coaxially with the central longitudinal axis 54 of the lance tip assembly on the inside surface of working face 25. As water flows downwardly through opening 44 its direction of flow begins to become influenced by the shape of protrusion 52. More specifically, the generally conical profile of the protrusion redirects the coolant water from substantially parallel to the lance axis 54 to substantially perpendicular thereto as it enters space 46. The contour of the protrusion 52 is calculated using an intermediate cooling water flow rate within the normal range recommended for a particular lance size, which flow rate is preferably approximately the mid-point of the recommended normal flow range for the particular lance size. The contour of protrusion 52 is defined by a series of calculated points downwardly projected from a base established by the perimeter points 80 (FIG. 1) of the opening 44. More particularly, the surface of protrusion 52 is defined by the continuously changing loci of points downwardly projected from the above-defined base to the conical projection of opening 44 on the inside surface of the working face 25 (reference numeral 58 in FIG. 4) which define a three-dimensional shape whose circumferential surface area is substantially constant and approximately equal to the area of opening 44. The present inventors have learned that maintaining a substantially constant flow area through this zone enhances the ability of the lance tip assembly to convey water at high velocity and more uniformly cool the lance tip.

As previously indicated, the number and size of nozzles 20 is dictated by the desired active material flow volume through the nozzles. The per-nozzle threshold flow area "A" for coolant water of known flow rate to achieve acceptable cooling of the lance tip assembly along the inside surface 56 of working face 25 radially outwardly from the conical projection 58 of opening 44 and point M may be defined by formula 2:

$$A = \frac{\text{application specific coolant water mass flow rate}}{\text{(design water velocity along inside face)}} \quad (2)$$

(number of nozzles)

To effectuate enhanced cooling of working face 25 through increasing velocity of coolant water flow across the inside surface 56 of the working face 25 from conical projection 58 outwardly (FIG.4), the threshold coolant water flow area may be reduced by a constant or variable factor x, where x is less than one.

Since the spacing between each nozzle 20 is a function of the number of nozzles required to discharge the desired flow of active material, the distance "Y" between the inside surface 56 working face 25 and the lower face 60 of the first component 10 (FIGS. 1, 2, and 4) must vary with increasing radius from conical projection 58 of opening 44 to provide a constant flow area for water passing between and around the forging legs 28. An illustrative but non-limitative example of the incremental variability of dimension "Y" is reflected by the substantially sinusoidal contour of the lower face 60 of first component 10 depicted in FIGS. 2 and 4. Area A is carefully controlled from conical projection 58 radially outwardly to location M (FIG. 4) beyond which the nozzle legs have a negligible effect on water flow. At this location the water area is calculated outside the nozzles as a full uninterrupted circumference multiplied by the distance from the inside surface of working face 25 and the lower face 60. By controlling the area at M, the cooling water flow is directed completely around the forging legs 28 to effectuate cooling on the entire circumferential surfaces thereof.

Pursuant to presently preferred embodiments, lance tip assemblies constructed according to the present invention convey coolant water through the lance tip water inlet I at a range of from about 33 to about 38 feet per second (fps). Thereafter, the water velocity preferably increases through space 46 up to about 42 to about 48 fps. Hence, the threshold coolant water flow area A reduction factor x through space 46 preferably ranges from about 0.67 to about 0.90 and more preferably about 0.75 to about 0.83.

If bypass passageways 42 are not present, adherence to formula (2) should be maintained from conical projection 58 of opening 44 substantially to the outer periphery of the nozzles. If the bypass passageways 42 are present, formula (1) should be implemented to establish the contour of lower face 60 of first component 10 for a radial distance at least equal to the distance between the conical projection 58 of opening 44 to the central longitudinal axes 62 of the nozzles 20 (FIG. 4). Under certain circumstances, however, continued implementation of formula (1) radially beyond axes 62 may be unnecessary because the water flow through bypass passageways 42 maybe be sufficient to satisfactorily cool the radially outermost peripheral regions of the nozzles.

In accordance with a further aspect of the invention, the second forged component 26 is worked or machined after forging to produce a shape which promotes substantially uniform cooling during lance operation. As mentioned previously, following forging of the second component 26 the forging legs 28 are internally hollowed such as by boring or the like (see, again, dashed lines 30 of FIG. 3) to form extensions of nozzle passageways 22. Also after forging, and either prior or subsequent to internal boring of the forging legs 28, the circumferential exteriors thereof, shown in dotted line 64 in FIG. 3, are machined to produce reduced diameter neck portions 66 adapted for mating insertion into corresponding sockets 68 provided in the lower ends of nozzles 20 (FIGS. 1 and 4). In addition to neck portions 66, the exterior of each forging leg is preferably machined to produce an undercut 70. The purpose of undercut 70 is to minimize the distance between the cooling water as it is circulated across the inside surface of the working face 25 and the "critical nozzle exit." This distance is identified by double headed arrow 72 in FIGS. 3 and 4. The "critical nozzle exit" is the radially innermost point of each of the discharge openings 24 in relation to the geometric center of the lance tip, i.e., axis 54. By minimizing distance 72 relative cold and hot spots are reduced at the working face of the tip, thereby reducing nozzle erosion and burn-through at the tip face. Because of the inherent limitations of the forging process, undercuts 70 must be formed after rather than during forging. Additionally, the outside face of second component 26 is preferably formed, either during or after forging, with a recess 74 generally corresponding in shape to protrusion 52. Recess 74 is desirable in that, along with undercuts 70, it tends to equalize the working face thickness of the second component 26 which promotes substantially uniform thermal characteristics therethrough.

Although the invention has been described in detail for the purpose of illustration, it is to be understood that such detail is solely for that purpose and that variations can be made therein by those skilled in the art without departing from the spirit and scope of the invention except as it may be limited by the claims. For example, although the illustrated lance assembly is constructed with a single centrally located active material delivery conduit, it is possible that the lance may contain more than one such passageway for delivering similar of dissimilar active materials. Likewise, it is also possible that the coolant water inlet passageway may disposed interiorly rather than exteriorly of one or more of the active material passageway(s).

What is claimed is:

1. A steelmaking lance tip assembly comprising:

a first cast metal component;

a second forged metal component; and at least one nozzle for delivering an active material to a furnace vessel, said at least one nozzle being formed in part from said first component and in part from said second component wherein said first and second components are directly joined to another at a single juncture site at each of said at least one nozzle.

2. The assembly of claim 1 wherein said first and second components are joined by one of welding, soldering, brazing and adhesion at said single juncture site.

3. A steelmaking lance tip assembly comprising:

at least one nozzle for delivering an active material to a furnace vessel;

passage means for conveying coolant fluid through said assembly such that an outlet velocity of coolant fluid conveyed through said assembly is greater than an inlet velocity of said coolant fluid; and a working face having an inside surface and an outside surface, and wherein said passage means comprises a per-nozzle threshold flow area interiorly of said inside surface defined according to the formula:

A=Application specific coolant water mass flow rate (design water velocity along inside face)(number of nozzles).

4. The assembly of claim 3 wherein said passage means comprise a substantially annular coolant fluid inlet and a substantially annular coolant fluid outlet wherein the area of said coolant fluid outlet is approximately equal to the area of said coolant fluid inlet.

5. The assembly of claim 3 wherein said passage means comprise a coolant fluid inlet, a coolant fluid outlet and at least one bypass passageway substantially corresponding in number and disposition to said at least one nozzle for conveying coolant fluid to radially outermost areas of said at least one nozzle.

6. The assembly of claim 3 wherein, to increase the velocity of coolant fluid passing along said inside surface, said threshold flow area is reducible by a constant or variable factor less than one.

7. A steelmaking lance tip assembly comprising:

at least one nozzle for delivering an active material to a furnace vessel;

passage means including a coolant fluid inlet, a first coolant fluid flow space, a second coolant fluid flow space, an opening providing communication between said first and second coolant fluid flow spaces, and a coolant fluid outlet;

a working face having an inside surface and an outside surface; and a centrally located protrusion on said inside surface having dimensions suitable to maintain a substantially constant flow area between said opening and a projection of said opening on said inside surface, wherein said passage means comprises a per-nozzle threshold flow area interiorly of said inside surface defined according to the formula:

A=Application specific coolant water mass flow rate (design water velocity along inside face) (number of nozzles).

8. The assembly of claim 7 wherein said protrusion has a contour defined by continuously changing loci of points downwardly projected from said opening to said projection of said opening on said inside surface, said loci of points defining a three-dimensional shape whose circumferential surface area is substantially constant and approximately equal to the area of said opening.

9. A steelmaking lance tip assembly comprising:

a first cast metal component;

a second forged metal component; and at least one nozzle for delivering an active material to a furnace vessel, said at least one nozzle being formed in part from said first component and in part from said second component, wherein said second component includes at least one nozzle forming portion and is undercut around said at least one nozzle forming portion following forging of said second component.

10. A steelmaking lance tip assembly comprising:

a first cast metal component;

a second forged metal component;

at least one nozzle for delivering an active material to a furnace vessel, said at least one nozzle being formed in part from said first component and in part from said second component; and a post disposed along a central longitudinal axis of said assembly and having an upper end affixed to said first component and a lower end affixed to said second component for providing structural support of said second component during operation of said assembly.

* * * * *

UNITED STATES PATENT AND TRADEMARK OFFICE

CERTIFICATE OF CORRECTION

PATENT NO. : 6,217,824 B1 
DATED : April 17, 2001
INVENTOR(S) : Theodore J. Leczo et al.

It is certified that error appears in the above-identified patent and that said Letters Patent is hereby corrected as shown below:

Column 8,
Line 63, the word -- one -- should be inserted between the words "to" and "another".

Column 9,
Line 13, the existing formula should be rewritten as follows:
-- A= Application specific coolant water mass flow rate
(design water velocity along inside face)(number of nozzles) --

Column 10,
Line 7, the existing formula should be rewritten as follows:
-- A= Application specific coolant water mass flow rate
(design water velocity along inside face)(number of nozzles) --

Signed and Sealed this

Thirty-first Day of August, 2004

JON W. DUDAS
*Director of the United States Patent and Trademark Office*